US008485173B1

(12) United States Patent
Tseng

(10) Patent No.: US 8,485,173 B1
(45) Date of Patent: Jul. 16, 2013

(54) AIRSOFT GUN

(76) Inventor: Shu-Mei Tseng, New Taipei (TW)

( * ) Notice: Subject to any disclaimer, the term of this patent is extended or adjusted under 35 U.S.C. 154(b) by 0 days.

(21) Appl. No.: 13/564,757

(22) Filed: Aug. 2, 2012

(51) Int. Cl.
*F41B 11/00* (2006.01)
*F41B 15/02* (2006.01)

(52) U.S. Cl.
USPC ..... 124/73; 124/71; 42/1.16; 42/71.02; 42/72

(58) Field of Classification Search
USPC ..... 124/71, 73; 42/1.16, 70.02, 71.02, 42/72, 87; 89/1.42
See application file for complete search history.

(56) References Cited

U.S. PATENT DOCUMENTS 2,964,031 A * 12/1960 Dotson ..... 124/57
4,790,824 A * 12/1988 Morrow et al. ..... 604/143
5,503,627 A * 4/1996 McKinnon et al. ..... 604/72
5,706,795 A * 1/1998 Gerwig ..... 124/71
6,499,477 B1 * 12/2002 Brock ..... 124/56
7,237,543 B2 * 7/2007 Su ..... 124/71
7,293,558 B2 * 11/2007 Ambrico ..... 124/71
2005/0217655 A1 * 10/2005 Jones ..... 124/73
2005/0268893 A1 * 12/2005 Ho et al. ..... 124/73
2008/0017180 A1 * 1/2008 Maeda et al. ..... 124/74
2009/0114201 A1 * 5/2009 Halmone ..... 124/74
2011/0120437 A1 * 5/2011 Tippmann et al. ..... 124/74
2012/0000453 A1 * 1/2012 Chung et al. ..... 124/71

* cited by examiner

*Primary Examiner* — Samir Abdosh
*Assistant Examiner* — Derrick Morgan

(57) ABSTRACT

An airsoft gun includes a stock and barrel assembly including a rear compressed propellant gas container having a seal, a spring biased striker disposed forwardly of the seal, a chamber disposed forwardly of the striker, a sliding weight in the chamber, a receiver disposed forwardly of the chamber, and an annular trough on an inner surface of a forward portion of the gun; a spring biased cap member locked at a forward opening; a pistol grip extending laterally out of the receiver and including two opposite three-section slots on a surface; a magazine assembly in the pistol grip; a and trigger assembly at bottom of the pistol grip and including a spring biased spacer engaging the bottom pellet, a cap element at the bottom of the pistol grip, and two safety pins through the cap element and the slots to lockingly urge against the spacer in a safe position.

5 Claims, 12 Drawing Sheets

AIRSOFT GUN

BACKGROUND OF THE INVENTION

1. Field of the Invention

The invention relates to air guns and more particularly to an airsoft gun with improved characteristics including being shaped as a side-handle baton and enhanced safety mechanism.

2. Description of Related Art

Typically, batons are carried for forced compliance and self-defense purposes by for example, law-enforcement officers. A baton may be used to strike, jab, block, bludgeon and aid in the application of arm-locks.

Airsoft guns are replica firearms that fire plastic pellets by way of compressed gas or electric and/or spring-driven pistons. Depending on the mechanism driving the pellet, an airsoft gun can be operated manually or cycled by either compressed gas such as Green Gas (propane and silicone mix) or $CO_2$, or by compressed air via a spring or an electric motor pulling a piston. All these products are designed to be non-lethal and to provide realistic replicas.

However, airsoft guns shaped as conventional side-handle baton are not commercially available are far as the present inventor is concern. Thus, the invention is neither taught nor rendered obvious.

SUMMARY OF THE INVENTION

It is therefore one object of the invention to provide an airsoft gun comprising a stock and barrel assembly comprising a rear compressed propellant gas container, a seal disposed at an opening of the compressed propellant gas container, a spring biased striker disposed forwardly of the seal, a chamber disposed forwardly of the striker, a weight slidably disposed in the chamber, a receiver disposed forwardly of the chamber and communicating therewith, the receiver including a spring biased lock, a forward opening, and an annular trough disposed on an inner surface of a forward portion of the stock and barrel assembly proximate the forward opening; a spring biased cap member locked at the forward opening and comprising a central, stepped diameter passageway, a spring biased piston removably disposed in the central, stepped diameter passageway, a retaining ring for locking a rear end of the piston at a rear portion of the central, stepped diameter passageway, the piston including an intermediate annular groove offset from the trough, and a peripheral surface adjacent to the groove, and a lock ball locked between the trough and the peripheral surface of the piston and in a surface of the central, stepped diameter passageway; a pistol grip extending laterally out of the receiver and comprising two opposite three-section slots disposed on a surface proximate a bottom; a magazine assembly disposed in the pistol grip for containing a plurality of plastic pellets wherein the top one of the pellets is adjacent to the receiver; a trigger assembly disposed at a bottom of the pistol grip and comprising a spring biased spacer engaging the bottom one of the pellets, a cap element releasably disposed at the bottom of the pistol grip, and two safety pins releasably, moveably disposed through the cap element and the slots to lockingly urge against the spacer in a safe position of the trigger assembly; wherein one ends of the slots are a ready to fire position of the trigger assembly, intermediate sections of the slots are the safe position of the trigger assembly, and the other ends of the slots are a position for dislodging the cap element.

The above and other objects, features and advantages of the invention will become apparent from the following detailed description taken with the accompanying drawings.

DETAILED DESCRIPTION OF THE INVENTION

Figure 1:
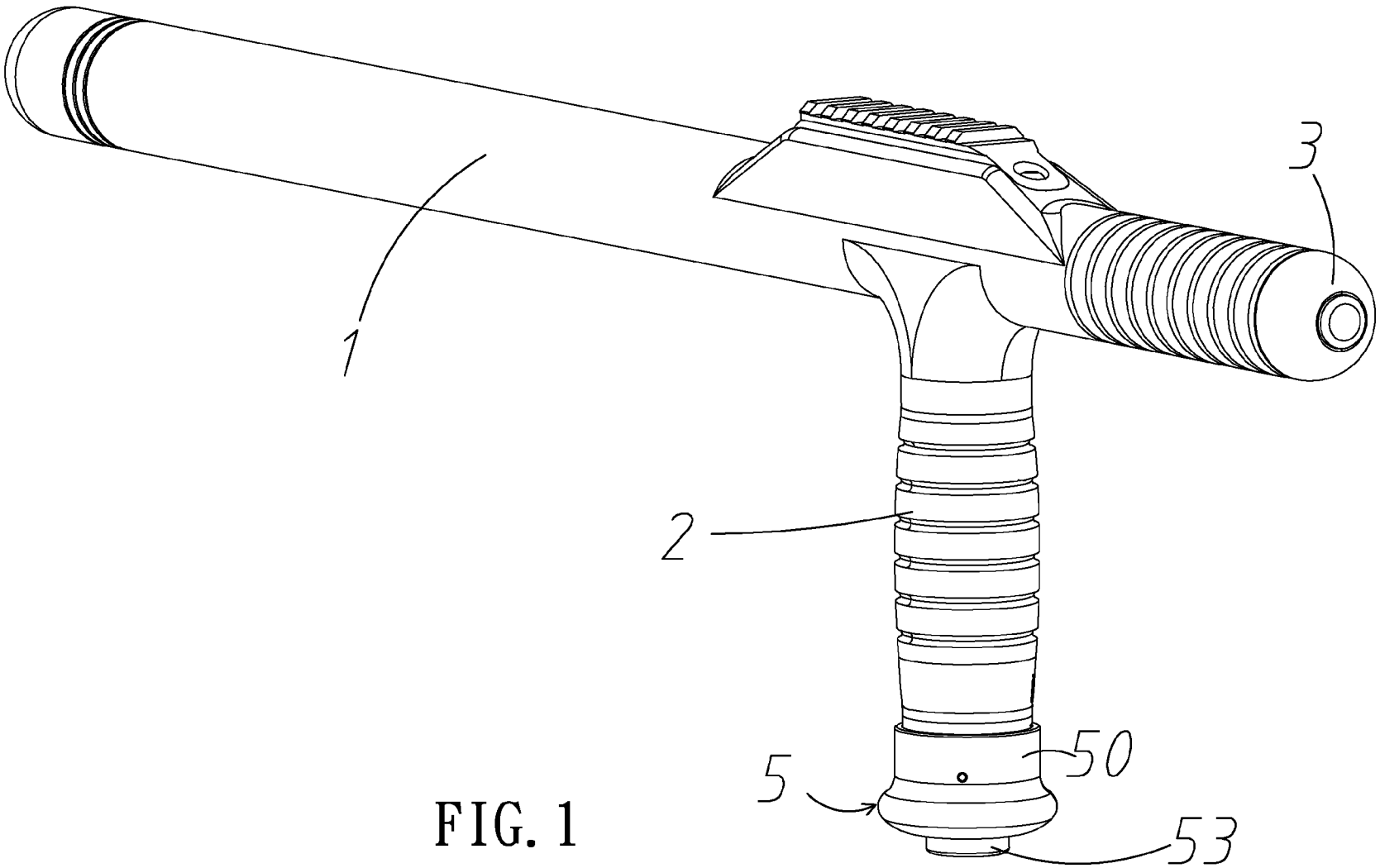
FIG. 1 is a perspective view of an airsoft gun according to the invention.
Figure 2:
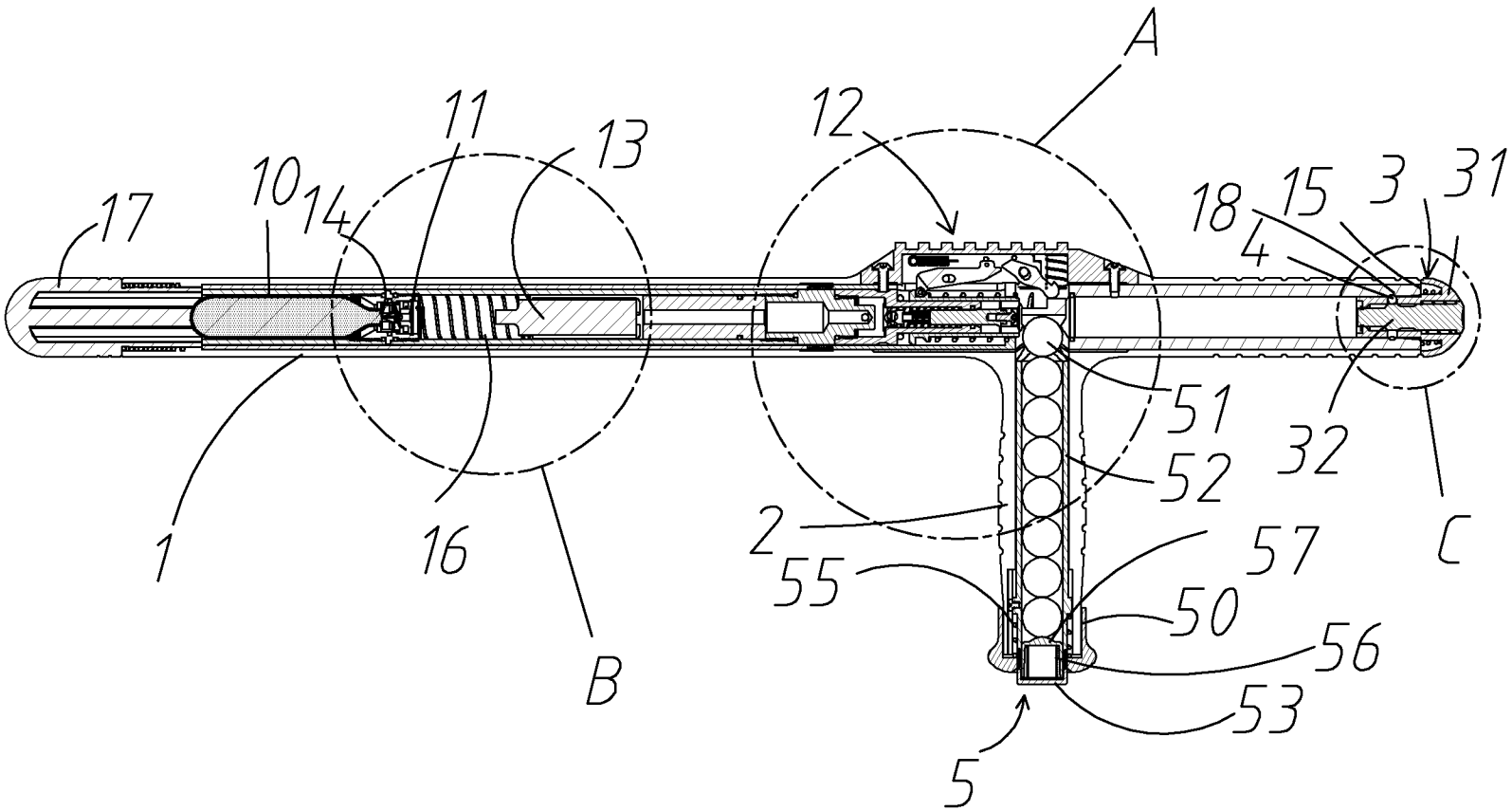
FIG. 2 is a longitudinal sectional view of the airsoft gun.
Figure 3:
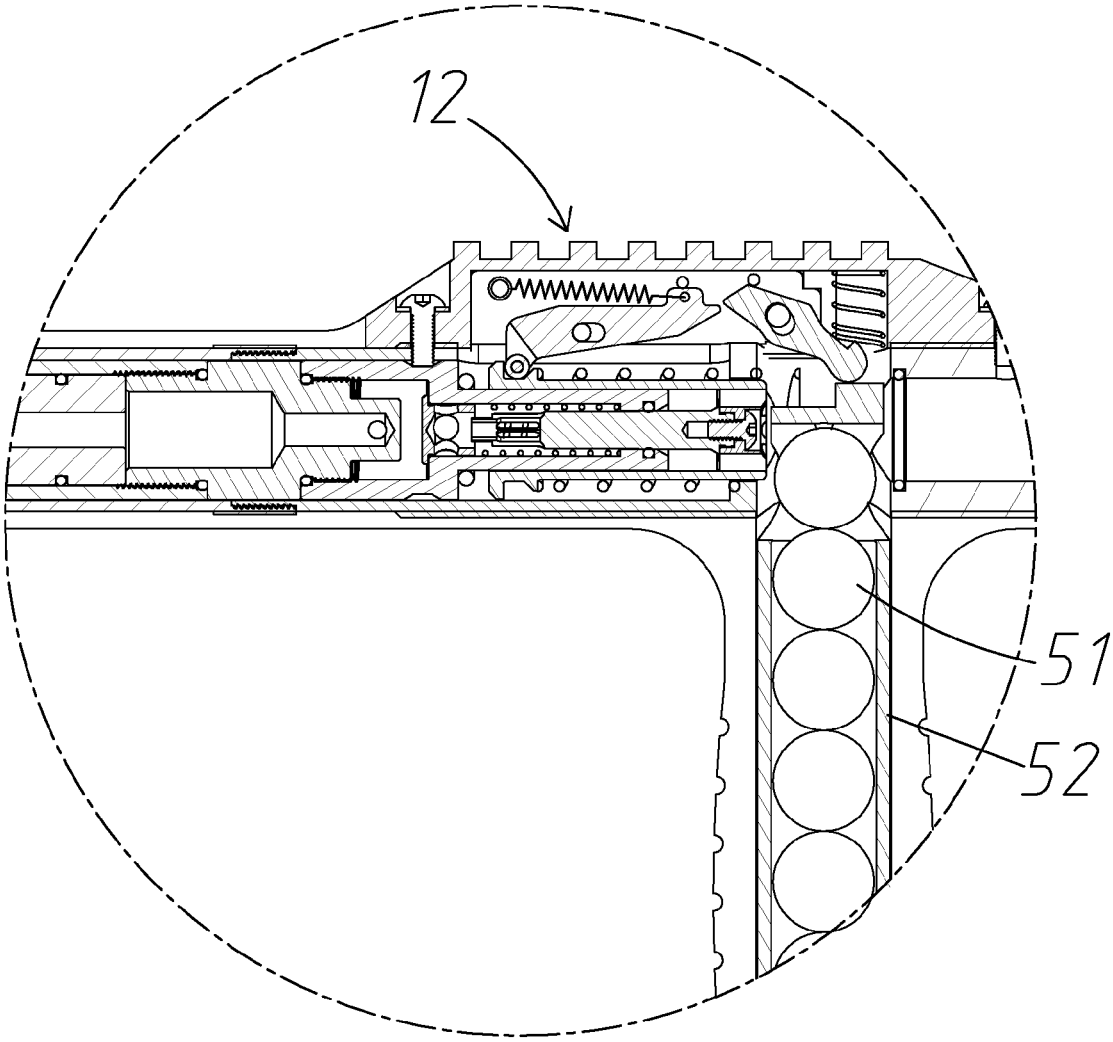
FIG. 3 is a detailed view of the area in circle A of FIG. 2.
Figure 4:
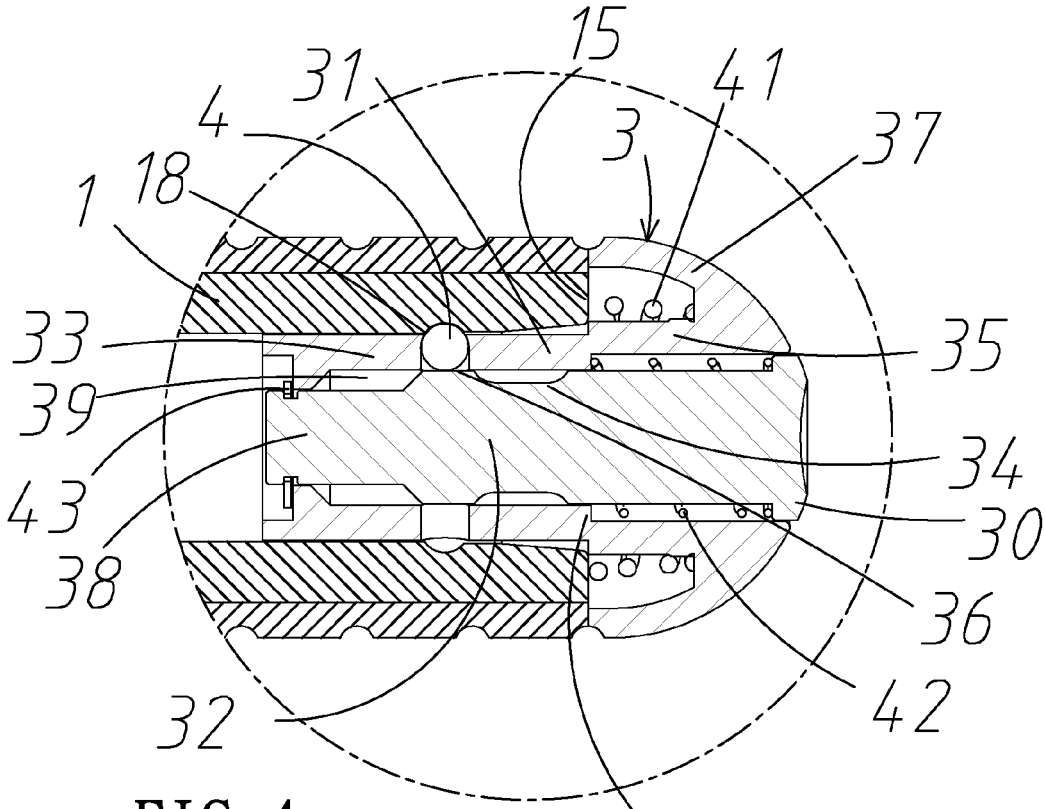
FIG. 4 is a detailed view of the area in circle C of FIG. 2.
Figure 5:
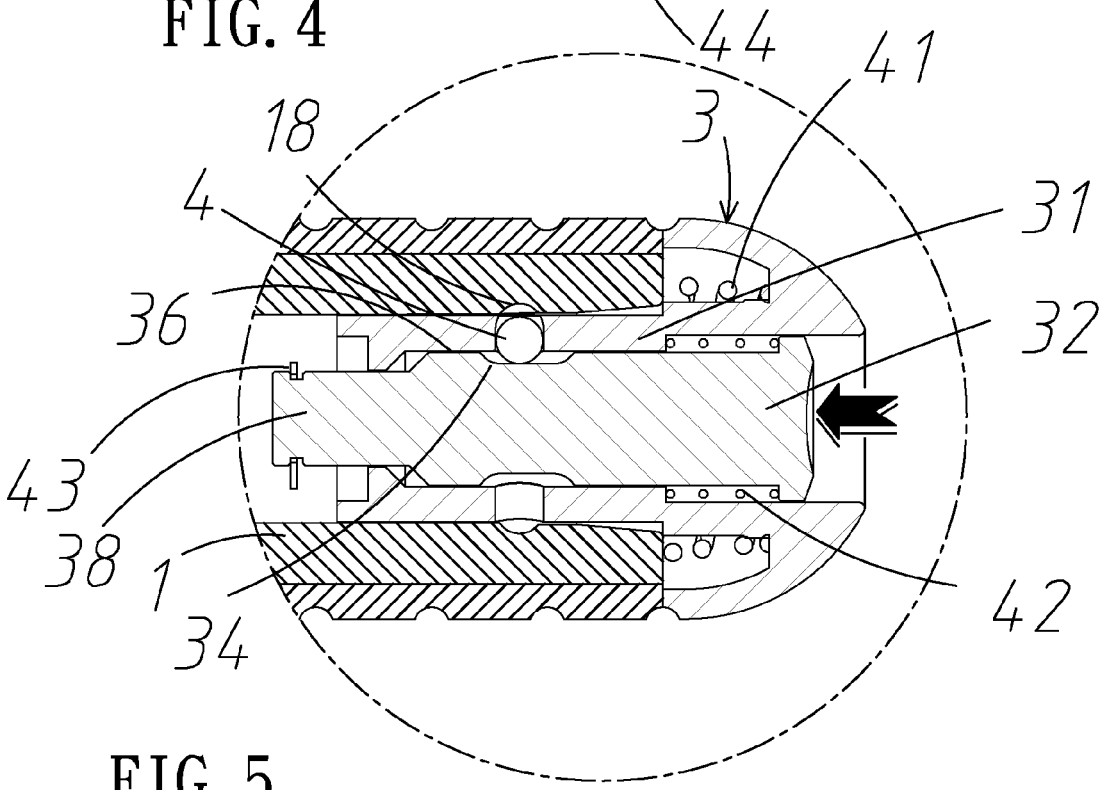
FIG. 5 is a view similar to FIG. 4 showing a depressing of the piston as a first step of removing the cap member.
Figure 5A:
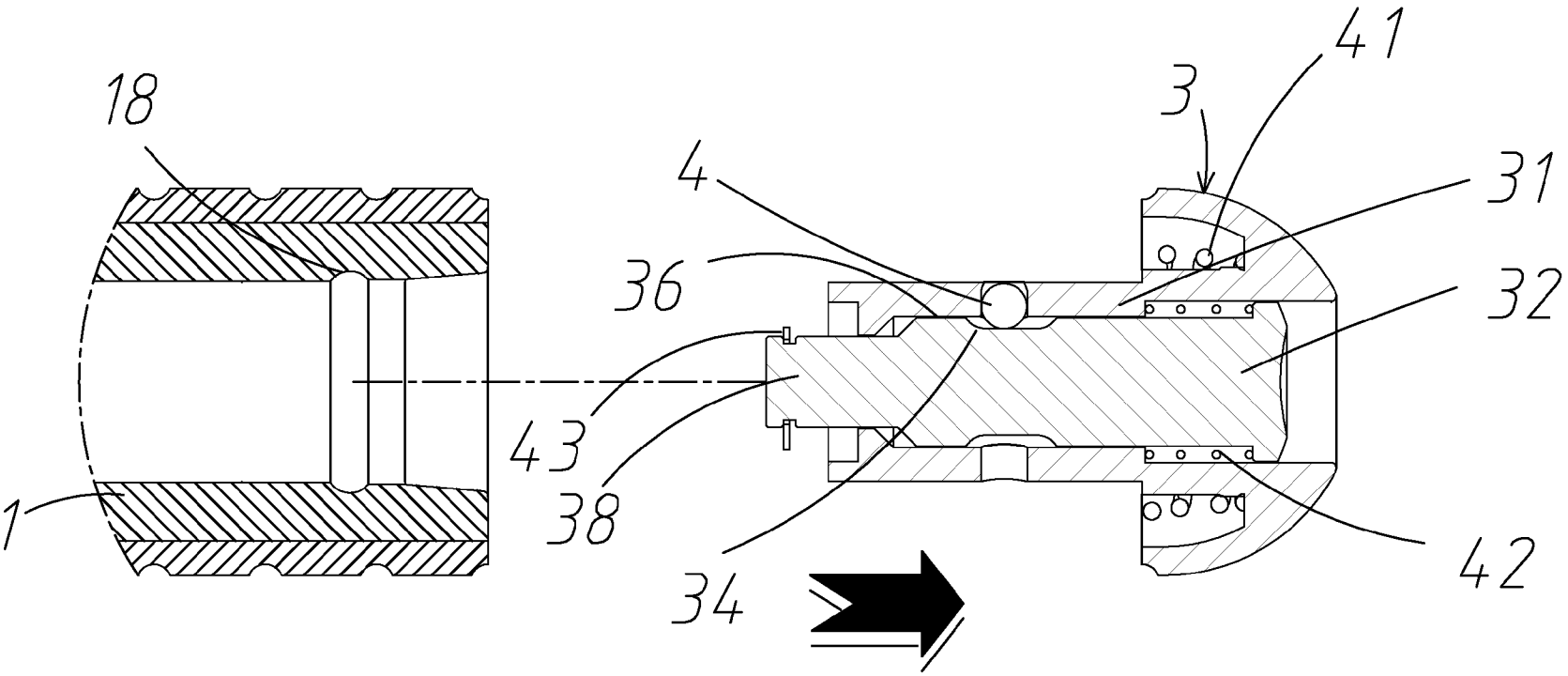
FIG. 5A is a view similar to FIG. 5 showing the cap member being bounced out of the gun as the final removal step.
Figure 6:
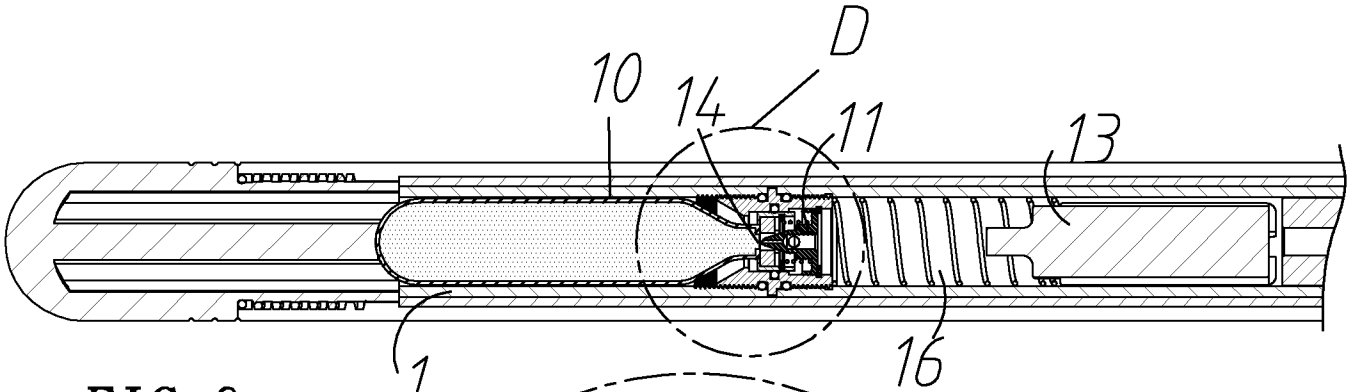
FIG. 6 is a detailed view of the area in circle B of FIG. 2.
Figure 7:
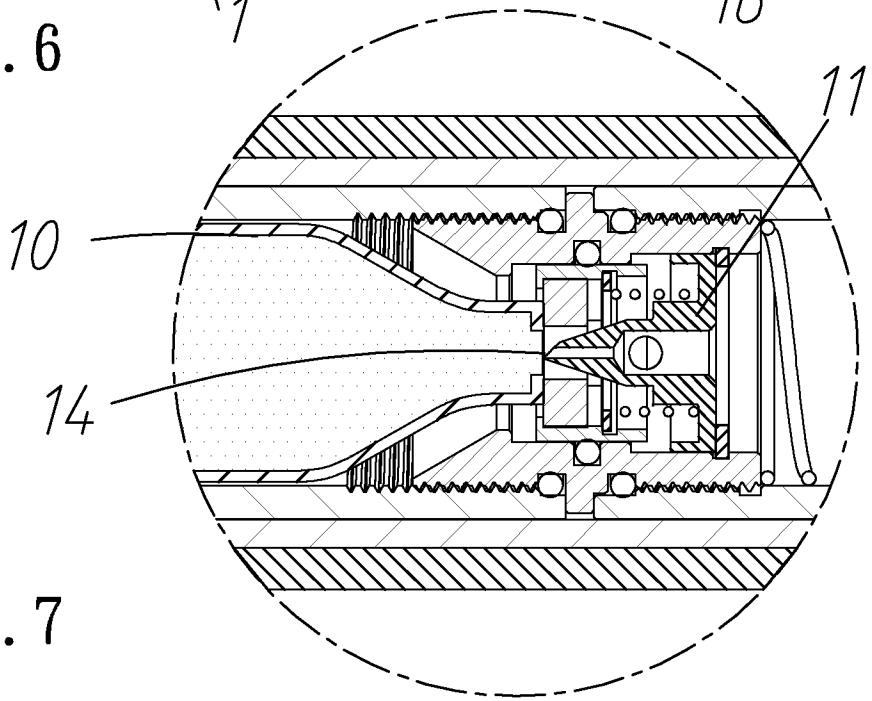
FIG. 7 is a detailed view of the area in circle D of FIG. 6.
Figure 8:
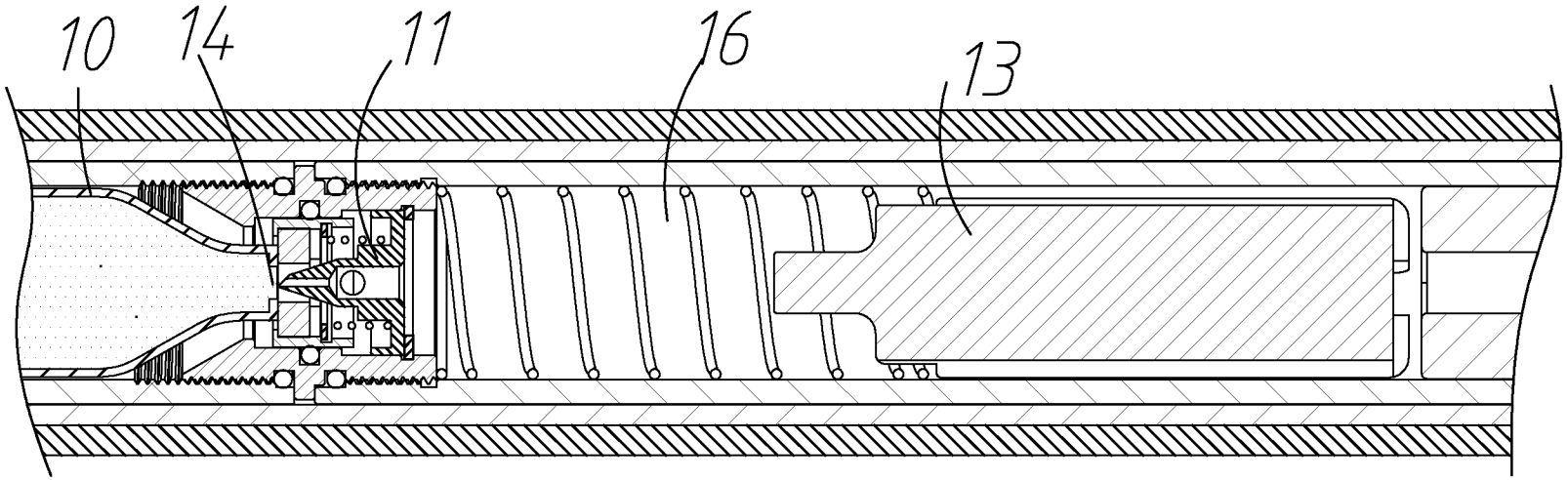
FIG. 8 is an enlarged view of the right and intermediate portions of FIG. 6.
Figure 9:
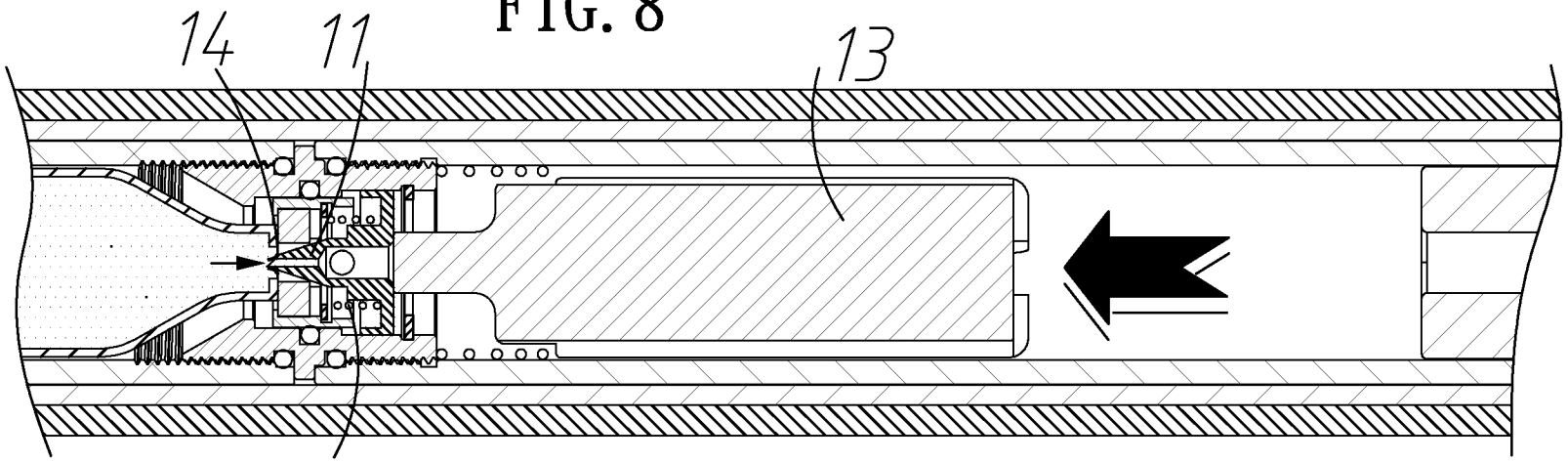
FIG. 9 is a view similar to FIG. 8 showing the sliding weight moving leftward to push the striker which in turn impinges the seal to open the air container.
Figure 10:
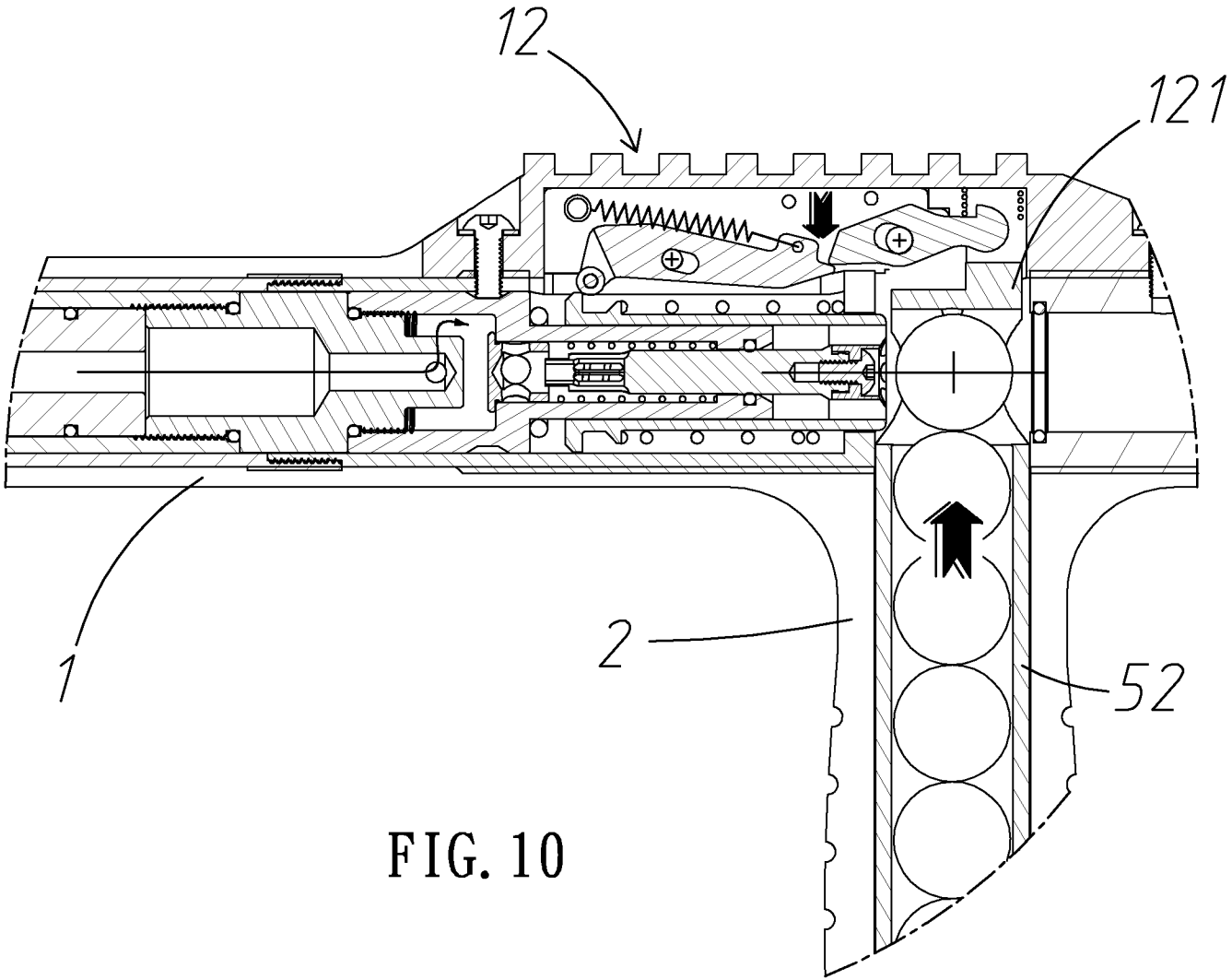
FIG. 10 is a view similar to FIG. 3 showing the lock of the receiver being unlocked by the upward movement of the top pellet so as to allow compressed air to pass through the receiver.
Figure 11:
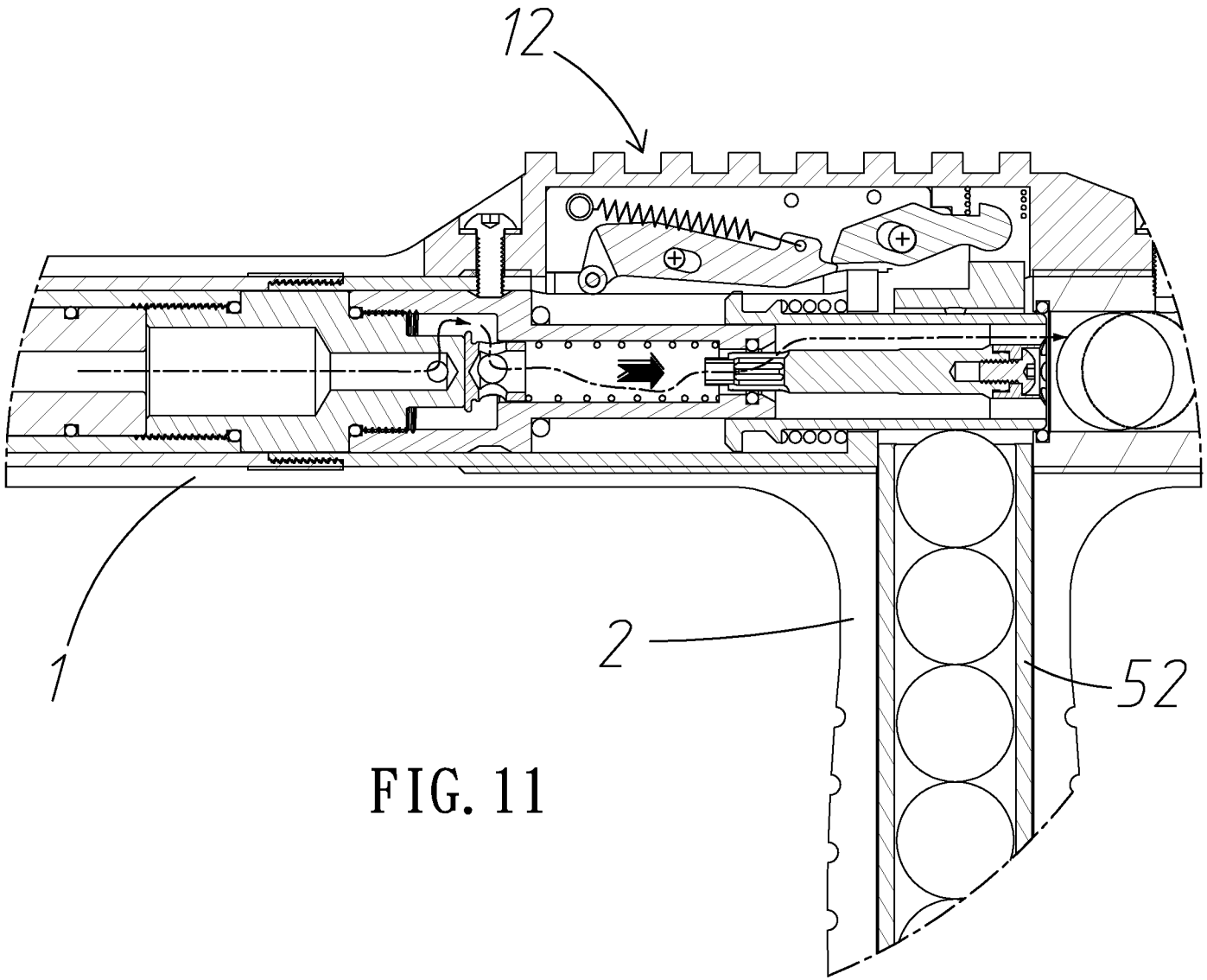
FIG. 11 is a view similar to FIG. 10 showing the top pellet having been pushed forward by the compressed air after leaving the receiver.

Referring to FIGS. 1 to 14, an airsoft gun in accordance with the invention comprises the following components as discussed in detail below.

A cylindrical stock and barrel assembly 1 and a pistol grip 2 are provided and they are shaped as a T. A receiver 12 is provided at a joining portion of the pistol grip 2 and the stock and barrel assembly 1. A rear end of the stock and barrel assembly 1 is provided with a threaded cap 17. A high pressure air container (or compressed propellant gas container) 10 is provided forwardly of the cap 17 and fastened by the cap 17 from behind. The high pressure air container 10 is the drive source of the gun as detailed later. A striker 11 is provided forwardly of an opening of the air container 10. A seal 14 is provided at the opening of the air container 10. A torsion spring 19 is put on the striker 11 for sealingly engaging the striker 11 with the seal 14 in an inoperative position of the gun. A chamber 16 is provided forwardly of the striker 11 and a sliding weight 13 is slidably provided in the chamber 16. An annular trough 18 is provided on an inner surface of a forward portion of the stock and barrel assembly 1 proximate a forward opening 15 of the stock and barrel assembly 1. The opening 15 communicates with the chamber 16 via the receiver 12 in use.

A cap member 3 is provided at the forward opening 15 of the stock and barrel assembly 1 and comprises a half-spherical member 37, a hollow, cylindrical portion 35 formed with a central portion of the half-spherical member 37, a first spring (e.g., torsion spring) 41 put on the hollow, cylindrical portion 35 and biased between the opening 15 and a blind portion of the half-spherical member 37 around the hollow, cylindrical portion 35, a first bore portion 31 formed with the hollow, cylindrical portion 35 and aligned therewith, the first bore portion 31 having a diameter less than that of the hollow, cylindrical portion 35 so that a shoulder 44 is formed therebetween, a second bore portion 33 spaced from the first bore portion 31 and having a diameter the same as that of the first bore portion 31, a channel 39 formed through the second and first bore portions 35, 31 and the hollow, cylindrical portion 35, a piston 32 provided in the channel 39 and having a rear portion 38 being locked by a rear end of the second bore portion 33 by using a retaining ring 43, the piston 32 including an intermediate annular groove 34 which is offset from the trough 18 in an inoperative position of the gun, a second spring (e.g., torsion spring) 42 put on a forward portion of the piston 42 and biased in the hollow, cylindrical portion 35 by urging against the shoulder 44 and an annular blind portion between a flange head 30 of the piston 32 and the hollow, cylindrical portion 35, and a lock ball 4 locked in a space defined by the trough 18, a peripheral surface 36 of the piston 32 adjacent to the groove 34, the first bore portion 31, and the second bore portion 33 in an inoperative position of the gun.

A firing and magazine assembly 5 is provided within the pistol grip 2 and around a bottom of the pistol grip 2. Two opposite three-section slots 58 are provided on a surface of the hollow pistol grip 2 proximate its bottom. The firing and magazine assembly 5 comprises a magazine 52 provided in the pistol grip 2 and having a plurality of plastic pellets 51 stored therein, the top pellet 51 being adjacent to the receiver 12, an inverted cup shaped spacer 57 provided below the bottom pellet 51 and engaging therewith, a helical spring 56 provided in the spacer 57, a torsion spring 55 put on a lower portion of the magazine 52, a hollow cap element 50 provided at the bottom of the pistol grip 2, and two safety pins 54 releasably, moveably provided through the cap element 50 and the slots 58 to lockingly urge against the spacer 57 in an inoperative (i.e., safe) position.

Figure 12:
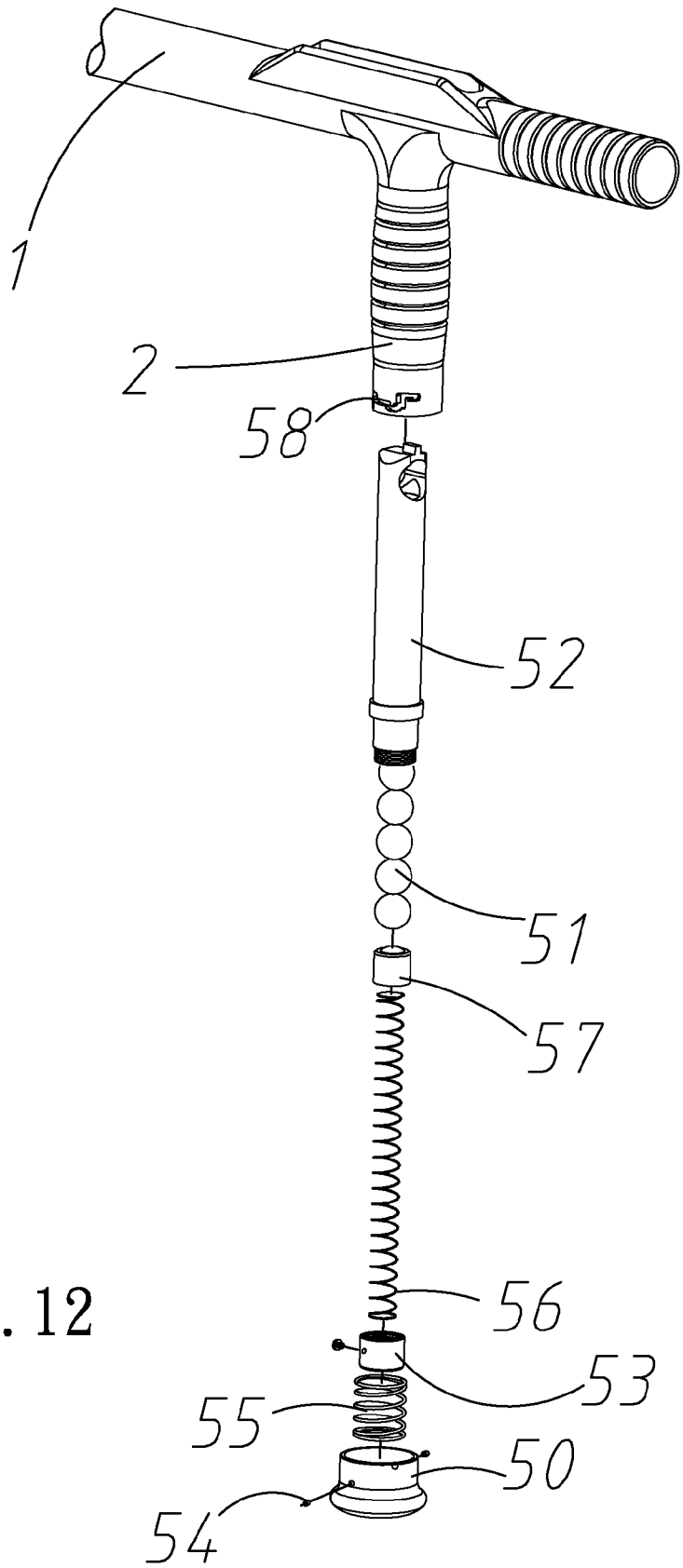
FIG. 12 is a perspective view of the gun with a rear portion of the stock and barrel assembly broken away and the firing and magazine assembly being shown in exploded view.
Figure 13:
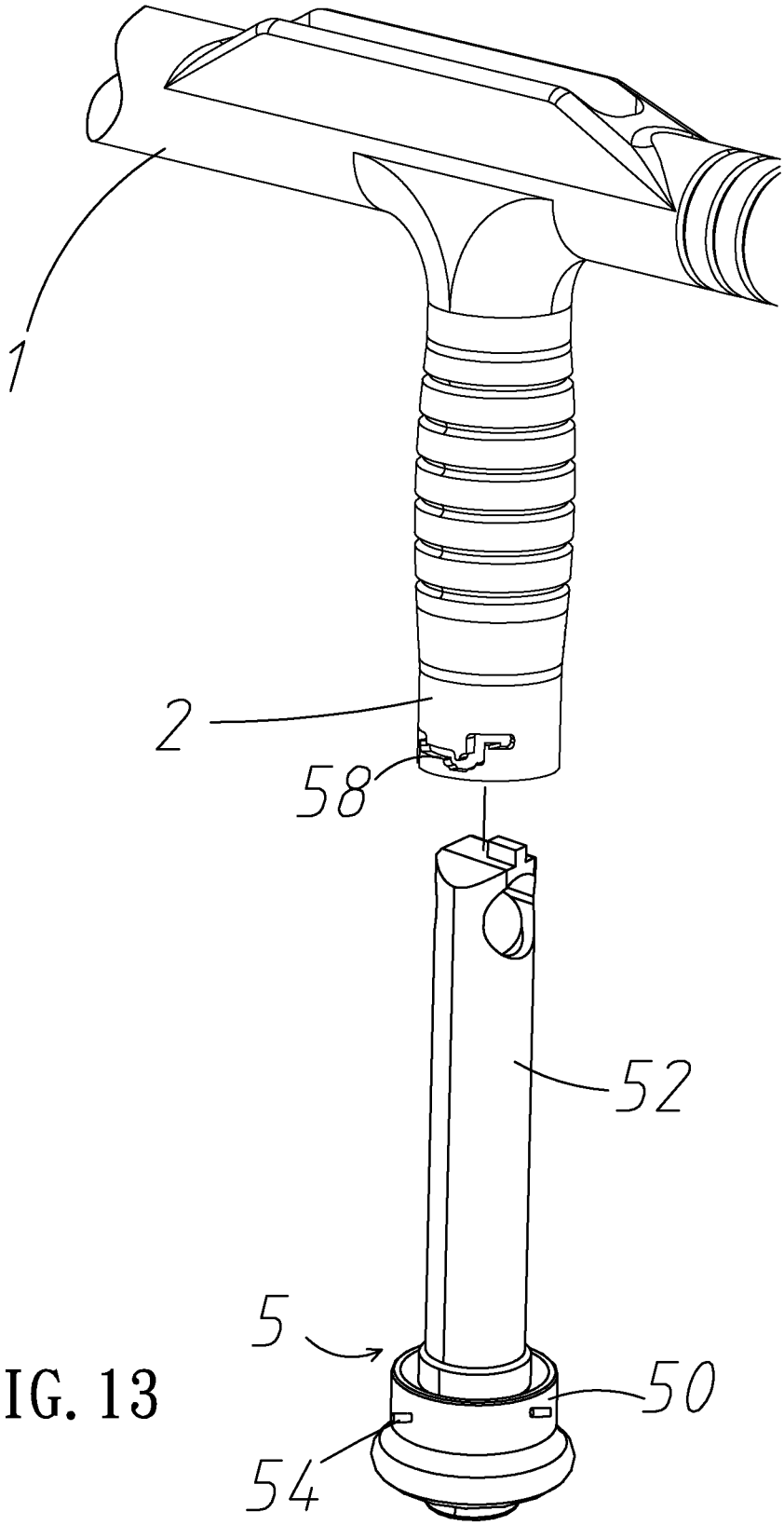
FIG. 13 is a view similar to FIG. 12 showing the assembled firing and magazine assembly to be secured to the pistol grip.
Figure 14:
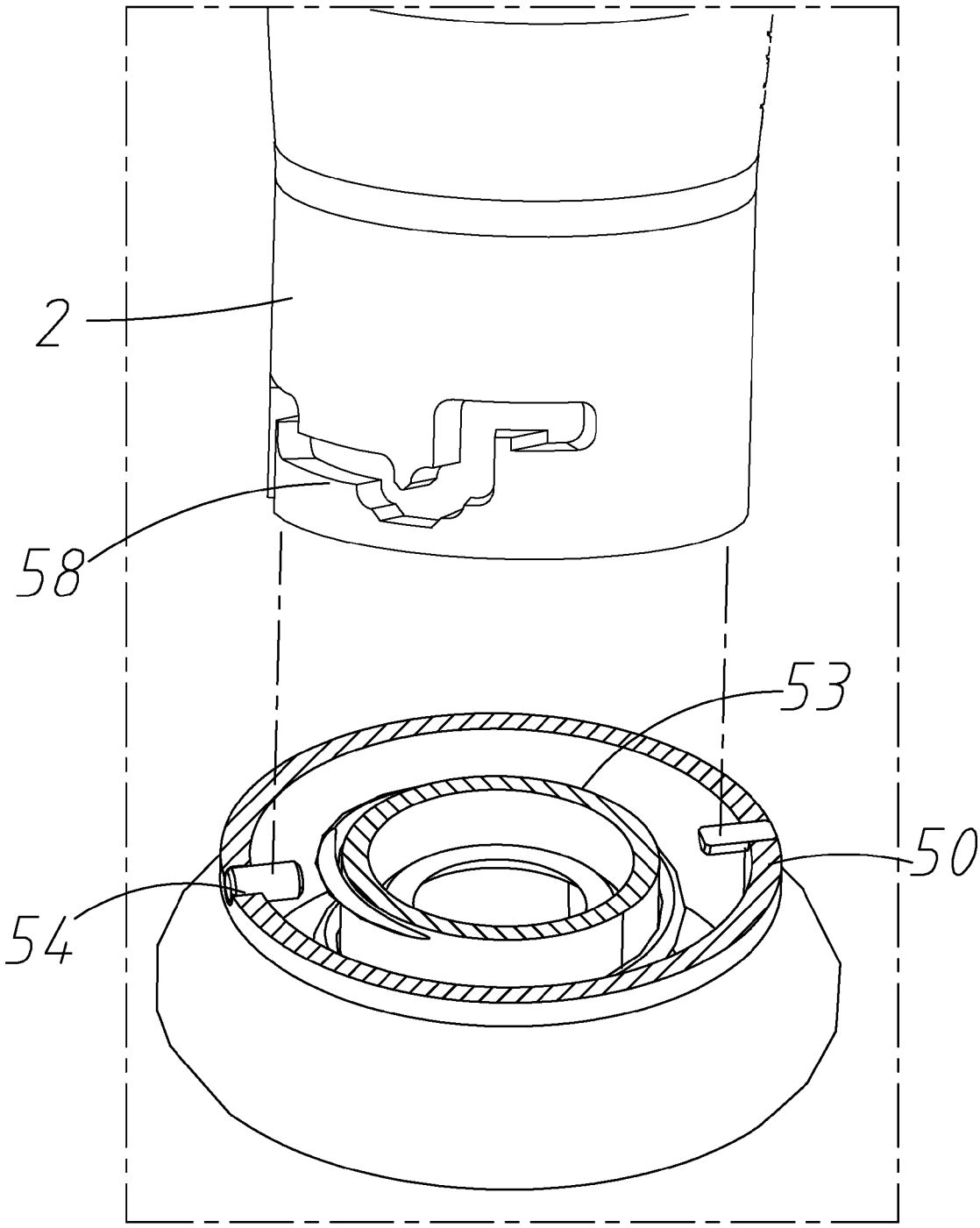
FIG. 14 schematically shows the bottom of the pistol grip and the cap element to be assembled.

As shown in FIG. 12, the left section of the slot 58 is a ready to fire position of the firing and magazine assembly 5 as detailed later, the intermediate section of the slot 58 is the safe position of the firing and magazine assembly 5, and the right section of the slot 58 is a position for dislodging the cap element 50 by causing the safety pins 54 to clear the slots 58.

Following is a description of firing: First, a shooter may remove the cap member 3 by performing the following steps: The shooter may press the piston 32 inward with the second spring 42 being compressed and the groove 34 moving to a position radially aligned with the lock ball 4. And in turn, the lock ball 4 locked in the trough 18 clears the trough 18 to partially fall into the groove 34. Thus, the cap member 3 is not locked by the stock and barrel assembly 1. The energized first spring 41 thus expands to disengage the cap member 3 from the stock and barrel assembly 1.

Secondly, the shooter disposes the gun in an inclined position to slide the sliding weight 13 toward the striker 11 and strike the striker 11. And in turn, the striker 11 impinges the seal 14 to open the seal 14. Thus, compressed high pressure air in the air container 10 may flow to the receiver 12.

Thirdly, the shooter may rotate the cap element 50 to dispose the safety pins 54 in the left sections of the slots 58 (i.e., ready to fire position) by disengaging from the spacer 57. The spacer 57 is thus unlocked. The trigger 53 is pushed to be partially out of the bottom of the cap element 50 due to the expansion of the energized spring 56. The shooter may press the trigger 53 compress the spring 56 and move the spacer 57 toward the receiver 12. And in turn, the top pellet 51 pushes to activate a spring actuated lock 121 of the receiver 12. Thus unlocked lock 121 thus allows the high pressure air to push the pellet 51 forward. Finally, the pellet 51 is discharged of the gun at the opening 15. In brief, a semi-automatic firing mode is implemented by the gun.

While the invention has been described in terms of preferred embodiments, those skilled in the art will recognize that the invention can be practiced with modifications within the spirit and scope of the appended claims.

What is claimed is:

1. An airsoft gun comprising:

a stock and barrel assembly comprising a rear compressed propellant gas container, a seal disposed at an opening of the compressed propellant gas container, a spring biased striker disposed forwardly of the seal, a chamber disposed forwardly of the striker, a weight slidably disposed in the chamber, a receiver disposed forwardly of the chamber and communicating therewith, the receiver including a spring biased lock, a forward opening, and an annular trough disposed on an inner surface of a forward portion of the stock and barrel assembly proximate the forward opening;

a spring biased cap member locked at the forward opening and comprising a central, stepped diameter passageway, a spring biased piston removably disposed in the central, stepped diameter passageway, a retaining ring for locking a rear end of the piston at a rear portion of the central, stepped diameter passageway, the piston including an intermediate annular groove offset from the trough, and a peripheral surface adjacent to the groove, and a lock ball locked between the trough and the peripheral surface of the piston and in a surface of the central, stepped diameter passageway;

a pistol grip extending laterally out of the receiver and comprising two opposite three-section slots disposed on a surface proximate a bottom;

a magazine assembly disposed in the pistol grip for containing a plurality of plastic pellets wherein the top one of the pellets is adjacent to the receiver; and a trigger assembly disposed at a bottom of the pistol grip and comprising a spring biased spacer engaging the bottom one of the pellets, a spring biased cap element releasably disposed at the bottom of the pistol grip, and two safety pins releasably, moveably disposed through the cap element and the slots to lockingly urge against the spacer in a safe position of the trigger assembly;

wherein one ends of the slots are a ready to fire position of the trigger assembly, intermediate sections of the slots are the safe position of the trigger assembly, and the other ends of the slots are a position for dislodging the cap element.

2. The airsoft gun of claim 1, wherein a pressing of the piston radially aligns the groove with the lock ball and causes the lock ball to clear the trough to partially fall into the groove, thereby unlocking the cap member.

3. The airsoft gun of claim 1, wherein the weight moves to push the striker when the stock and barrel assembly is inclined at or greater than a predetermined angle.

4. The airsoft gun of claim 3, wherein in response to pushing the striker, the seal is configured to open when the striker impinges thereon.

5. The airsoft gun of claim 4, wherein in response to opening the seal, a rotation of the cap element disposes the safety pins at the ready to fire position of the trigger assembly, unlocks the spacer disengaging the safety pins from the spacer, and pushes the trigger to be partially out of the cap element; and a pressing of the trigger moves the spacer toward the receiver to push the top pellet to unlock the spring actuated lock, thereby allowing compressed propellant gas to push the top pellet forwardly.

* * * * *